United States Patent [19]

Hay, II et al.

[11] Patent Number: 4,499,749

[45] Date of Patent: Feb. 19, 1985

[54] TUBING PERFORATOR

[75] Inventors: Robert A. Hay, II; Brian W. Krause, both of Midland, Mich.

[73] Assignee: The Dow Chemical Company, Midland, Mich.

[21] Appl. No.: 47,422

[22] Filed: Jun. 11, 1979

[51] Int. Cl.[3] ..... B21D 28/28; B21D 31/02

[52] U.S. Cl. ..... 72/325; 72/324; 72/370; 83/184

[58] Field of Search ..... 72/325, 324, 326, 327, 72/370; 83/178, 184; 30/358, 360, 361, 368

[56] References Cited

U.S. PATENT DOCUMENTS 1,432,073 10/1922 Lowy ..... 72/325

1,588,200 6/1926 Skelton ..... 83/178

3,271,988 9/1966 Klinksier ..... 72/325

FOREIGN PATENT DOCUMENTS 918923 2/1963 United Kingdom ..... 83/184

*Primary Examiner*—Daniel C. Crane

*Attorney, Agent, or Firm*—R. B. Ingraham

[57] ABSTRACT

A tube perforator is provided which has a generally cylindrical mandrel which extends within a tube. The mandrel is hollow and has a passage therein which extends in angular relation to the axis of the mandrel and exits on one side thereof. A punch disposed in the passage can be driven against the tube wall to cause perforation thereof.

12 Claims, 4 Drawing Figures

TUBING PERFORATOR

Heat exchange devices such as tube and shell heat exchangers occasionally need repair when one or more of the tubes fail because of corrosion or other reasons. Frequently it is the practice when one such failure or leak occurs the offending tube or tubes are plugged at either end and the heat exchanger is operated until further failure occurs. When a sufficient number of tubes have failed in a tube and shell heat exchanger, the heat exchanger is generally removed from service, the tubes removed and replaced with new tubes. Occasionally, when a repaired tube and shell heat exchanger has been in service with some tubes plugged, one of the plugged tubes may contain liquid or gas and liquid under pressure. On removal of the plug such liquid has on occasion caused injury to the boilermaker removing the plugs.

It would be desirable if there were available a means of reducing the possibility of a plugged tube in a tube and shell heat exchanger containing fluid under pressure.

It would also be desirable if there were available a simple device for the perforation of such tubes prior to plugging.

It would also be desirable if such a device were small, compact and readily operated.

These benefits and other advantages in accordance with the present invention are achieved in a tubing perforator, the tubing perforator comprising a body, the body having a first end and a second end, the second end of the body defining a generally cylindrical mandrel having a longitudinal axis of generation, the mandrel generally being a sliding fit within a tube which it is desired to perforate, the mandrel being disposed adjacent a generally radially extending shoulder defined by the body, the shoulder adapted to be disposed adjacent a tube sheet when the mandrel is positioned within a tube to be perforated, a generally axially extending passageway extending from the first end of the body, through the body and terminating adjacent the second end of the generally cylindrical surface of the mandrel, the axis of the passage being angularly disposed relative to the axis of the mandrel, the passageway being generally linear and adapted to slideably receive a rigid punch.

Further features and advantages of the present invention will become more apparent from the following Specification taken in connection with the drawing wherein FIG. 1 is a longitudinal sectional view of a tubing perforator in accordance with the present invention.

Figure 1:
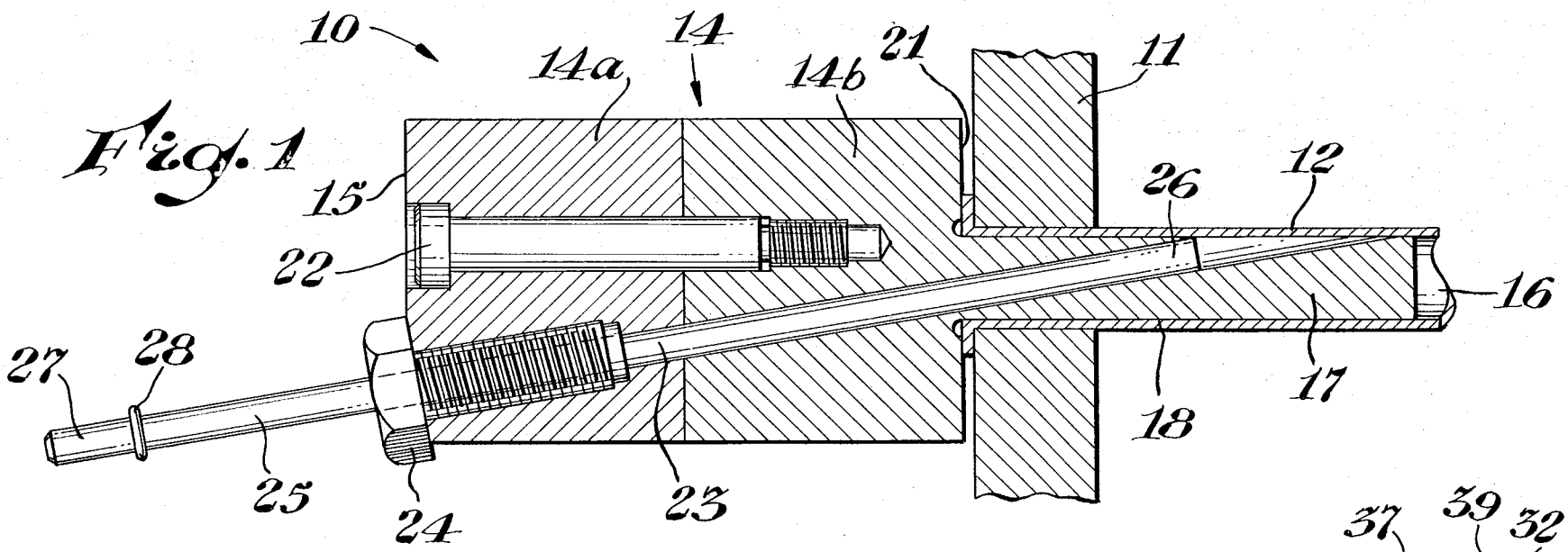

In FIG. 1 there is depicted a longitudinal sectional view of a tubing perforator in accordance with the present invention generally designated by the reference numeral 10. The tubing perforator 10 is shown in engagement with a tube sheet 11 and associated tube 12. The tubing perforator 10 has a body 14. The body 14 has a first end 15 and a second end 16. The body 14 adjacent to second end 16 defines a generally (and conveniently) cylindrical mandrel 17 generally concentrically disposed with the second end 15. The mandrel 17 has an external generally cylindrical surface 18 which is disposed generally within the tube 12 and is a sliding fit therefor. The body 14 adjacent the mandrel 17 and remote from the second end 16 defines a generally radially extending shoulder 21 which as depicted in FIG. 1 is adapted to be disposed adjacent to the tube sheet 11. The body 14 has a first or head portion 14*a* affixed to a second or mandrel supporting portion 14*b* and has an interface which extends generally normal to the longitudinal axis of the mandrel 17. The portions 14*a* and 14*b* are maintained in fixed demountable relationship by fastening means 22 which as depicted in FIG. 1 is a socket head bolt. A generally lineal passageway 23 extends from first end 15 of the body 14 to a location adjacent second end 16 of the body 14. The passageway 23 advantageously is of circular cross section. However, any desired cross section may be employed. The passageway extends from second end 15 and terminates generally on the cylindrical surface 18 of the mandrel 17. The mandrel 17 extends sufficiently far that the terminal portion of passageway 23 in mandrel 17 extends beyond the tube sheet 11. The axis of the passageway 23 is generally angularly disposed with respect to the axis of mandrel 17, the particular angle is dependent upon the thickness of tube sheet and diameter of tube to be perforated. However, for most purposes a desirable angle between the axis of the mandrel 17 and the axis of the passageway is from about 8 to 11 degrees and the optimum angle is believed to be about 9.5°. Disposed within the passageway 23 at the first end 15 is a punch extractor means or hexagon head cap screw 24 which threadably engages the body portion 14*a* at the first end 15 of the body 14. The extractor hexagon head cap screw partially defines the passageway 23 in a portion of body part 14*a* adjacent to second end 15. Disposed partially within the passageway 23 is a punch 25. The punch 25 is a sliding fit for the passageway 23. The punch has a first or cutting end 26 and a second or driving end 27. On the driving end 27 is a circumferentially disposed stop means 28. The stop means 28 advantageously is a circumferential weld bead.

Figure 2:
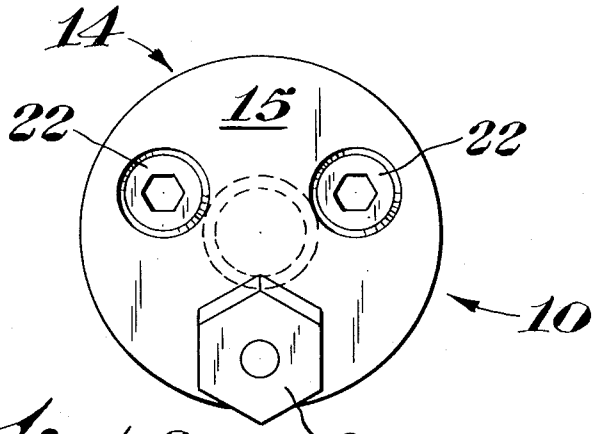
FIG. 2 is an end view of the device of FIG. 1.

In FIG. 2 there is depicted an end view of the apparatus 10 of FIG. 1 as when viewed from the first end 15. Two socket head shoulder screws are employed to maintain the body portions 14*a* and 14*b* in fixed relationship to each other.

Conveniently the device of FIG. 1 is readily prepared employing a lathe, milling machine and drill press. The body portion 14*b* is turned to the desired dimensions. The body portion 14*a* is turned to the desired dimensions. The holes for the cap screws 22 are drilled in both pieces simultaneously or separately, and the holes in portion 14*a* counter sunk and the holes in 14*b* tapped. The portion 14*a* and 14*b* are positioned together. The screws 22 are inserted and tightened. A portion of the end 15 of portion 14*a* is then milled to provide a surface which is perpendicular to the axis of the passageway 23. The passageway 23 is then drilled and optionally reamed. Desirably, the mandrel 17 preferably is made of a hardenable steel and is hardened by appropriate heat treating. The punch 25 advantageously is drill rod wherein the end 26 terminates in a surface generally extending normally to the axis of the drill rod and the second end 27 has a slight chamfer. The weld bead or stop means 28 is applied to the second end of the punch to prevent the punch from passing entirely through or entirely into the body 14.

In operation of the device 10 as disclosed in FIGS. 1 and 2, the mandrel 17 of the body 14 is positioned within a tube such as tube 12 which is desired to be perforated. The shoulder 21 is pushed against the tube sheet. The punch 25 inserted through the cap screw 24 and pushed to a position where the first end 26 is generally adjacent the tubing. The punch is then struck with a hammer until it is driven through the wall of the tube such as tube 12. In the event that the punch is driven into the tube in such a manner that it is difficult to remove, the weld bead 28 is driven to contact the head of the cap screw 24 and a wrench applied to the cap screw to move both the cap screw and the end 27 of the punch 25 away from second end 15 of the device 10. In the event that the punch breaks within the body 14, removal of the fastening means 22 permits possible access to a portion of the punch to aid in its removal. If this is unsuccessful, a second punch may be employed to drive the remnants of the first punch through the wall of the tube and permit removal of the mandrel 17 from the perforated tube. A convenient material for the body 14 is American iron and Steel Institute (AISIO 4140 steel. Any non-brittle drill rod is satisfactory for the punch. AISI S7 steel is satisfactory.

Figure 4:
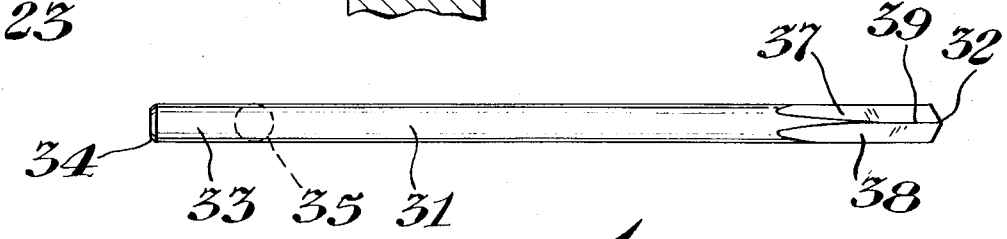
FIGS. 3 and 4 are two views of an alternative punch for use in the device of FIG. 1.
Figure 3:
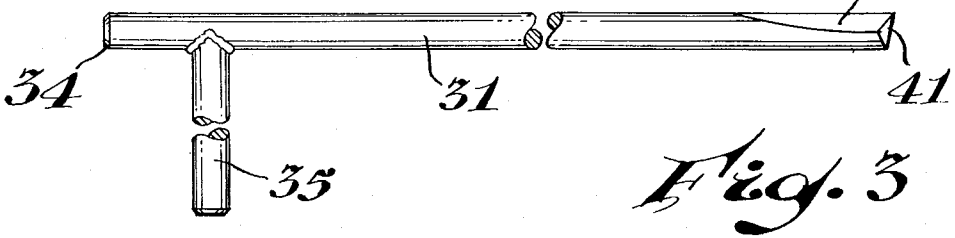

In FIGS. 3 and 4 is depicted an alternative punch for use with the device 10 in FIGS. 1 and 2. The punch is designated by the reference numeral 31. The punch 31 has a first or cutting end 32 and a second or driving end 33. The driving end 33 has a chamfered edge 34. An indexing means 35 is fixed to the punch 31 adjacent to the driving end 33. The indexing means as depicted in FIGS. 3 and 4 as an additional length of punch material welded at 90° to the punch. The first or cutting end 32 of the punch 31 defines a pair of opposed flat faces 37 and 38. Defined by the otherwise generally cylindrical punch, the faces 37 and 38 are disposed at 90° to each other and have a common edge 39. The faces extend from the first end 32 for a distance of about 1 inch when a one-fourth inch diameter rod is employed. The terminal end 32 of the punch 31 defines two end faces 41 (only one shown). Faces 41 are angularly disposed with respect to the axis of the punch 31 and slope toward first end 33 at an angle of about 60° at a location adjacent faces 37 and 38 and at an angle of about 10° in a plane generally normal to the axis of the punch 31. The punch of FIGS. 3 and 4 is particularly suited for more difficult alloys, such as Hastelloy. Punches in accordance with the present invention are readily prepared for a variety of sized tubing. Desirably, the overall length of the punch is from about $7\frac{1}{4}$ to 8 inches. The mandrel length is from about $3\frac{1}{4}$ to 4 inches. The distance from the shoulder to the closest exposed opening to passageway 23 from about $1\frac{3}{4}$ to $3\frac{1}{2}$ inches for nominal $\frac{3}{4}$ tube with wall thickness from 0.65 to 0.95 inch, one inch tubing with wall from 0.065 to 0.120 in thickness.

Beneficially, tubing perforators in accordance with the present invention are readily and easily employed to perforate heat exchanger tubing, boiler tubing and the like.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A tubing perforator body, the body having a first end and a second end, the second end of the body defining a generally cylindrical mandrel having a longitudinal axis of generation, the mandrel generally being a sliding fit within a tube which it is desired to perforate, the mandrel being disposed adjacent a generally radially extending shoulder defined by the body, the shoulder adapted to be disposed adjacent a tube sheet when the mandrel is positioned within a tube to be perforated, a generally axially extending passageway extending from the first end of the body, through the body and terminating adjacent the second end of the generally cylindrical surface of the mandrel, the axis of the pressure being angularly disposed relative to the axis of the mandrel, the passageway being generally linear and adapted to slideably receive a rigid punch.

2. The tubing perforator body of claim 1 wherein the passage is disposed at an angle of from about 8° to 11° from the axis of the member.

3. The tubing perforator body of claim 2 wherein the passage is disposed at an angle of about 9.5°.

4. The tubing perforator body of claim 1 including a punch extractor means disposed about the passage at the first end of the body.

5. The tubing perforator body of claim 4 wherein the punch extractor means threadably engages the first end of the body and is generally concentric with the passage.

6. The tubing perforator body of claim 1 wherein the body comprises a head portion and mandrel supporting portions, the portions being demountably affixed to each other and the portions having an interface which extends generally normal to the axis of the mandrel.

7. A tubing perforator, the tubing perforator comprising a body, the body having a first end and a second end, the second end of the body defining a generally cylindrical mandrel having a longitudinal axis of generation, the mandrel generally being a sliding fit within a tube which it is desired to perforate, the mandrel being disposed adjacent a generally radially extending shoulder defined by the body, the shoulder adapted to be disposed adjacent a tube sheet when the mandrel is positioned within a tube to be perforated, a generally axially extending passageway extending from the first end of the body, through the body and terminating adjacent the second end of the generally cylindrical surface of the mandrel, the axis of the passage being angularly disposed relative to the axis of the mandrel, the passageway being generally linear and having a rigid punch slidably disposed therein.

8. The tubing perforator of claim 7 wherein the passage is disposed at an angle of from about 8° to 11° from the axis of the member.

9. The tubing perforator of claim 8 wherein the passage is disposed at an angle of about 9.5°.

10. The tubing perforator of claim 7 including a punch extractor means disposed about the passage at the first end of the body.

11. The tubing perforator of claim 10 wherein the punch extractor means threadably engages the first end of the body and is generally concentric with the passage.

12. The tubing perforator of claim 7 wherein the body comprises a head portion and mandrel supporting portions, the portions being demountably affixed to each other and the portions having an interface which extends generally normal to the axis of the mandrel.

* * * * *